US005655432A

United States Patent [19]

Wilkosz et al.

[11] Patent Number: 5,655,432

[45] Date of Patent: Aug. 12, 1997

[54] SWASH PLATE WITH POLYFLUORO ELASTOMER COATING

[75] Inventors: Daniel Edward Wilkosz, Ypsilanti; Matthew John Zaluzec, Canton; Thomas Michel Dalka, Sterling Heights, all of Mich.

[73] Assignee: Ford Motor Company, Dearborn, Mich.

[21] Appl. No.: 568,707

[22] Filed: Dec. 7, 1995

[51] Int. Cl.[6] ..... F01B 3/00

[52] U.S. Cl. ..... 92/71; 417/269; 74/60; 29/888.02

[58] Field of Search ..... 92/12.2, 71; 417/269; 91/499; 74/60; 29/888.02

[56] References Cited

U.S. PATENT DOCUMENTS 3,455,585 7/1969 Raymond ..... 417/269
4,554,704 11/1985 Raffaeli .
4,568,252 2/1986 Hattori et al. ..... 417/269
5,013,219 5/1991 Hicks et al. ..... 417/269
5,056,417 10/1991 Kato et al. .
5,236,312 8/1993 Finn et al. .
5,415,077 5/1995 Ono ..... 92/71

*Primary Examiner*—Thomas E. Denion
*Attorney, Agent, or Firm*—Damian Porcari

[57] ABSTRACT

A swash plate type compressor having a cylinder block with cylinder bores disposed parallel to the axis of the cylinder block. A rotary shaft rotatably mounted within the cylinder block carries an aluminum swash plate. The swash plate is fixed to the rotary shaft and has two facial surfaces and an end surface. The facial surfaces have a coating of between 0.0005 inches to 0.002 inches of a heat curable, cross-linked polyfluoro elastomer bonded directly to the aluminum, a lubricious additive and a load bearing additive. A piston reciprocally fitted within the cylinder bore contains shoes which slideably intervene between the piston and the swash plate facial surfaces and reciprocate the pistons by rotation of the swash plate. The coating on the swash plate permits the use of slow silicon alloy aluminum without the need of metal plating or high finish polishing.

8 Claims, 5 Drawing Sheets

-2

ALUMINUM HAVING 7% SILICON

-3

ALUMINUM HAVING 17% SILICON

ALUMINUM HAVING 7% SILICON

ALUMINUM HAVING 17% SILICON

SWASH PLATE WITH POLYFLUORO ELASTOMER COATING

BACKGROUND OF THE INVENTION

1. Field of the Invention

The present invention relates to a swash plate type compressor for compressing a refrigerant gas, by rotating a swash plate. More particularly, the present invention relates to an improvement to swash plate compressors by applying a fluorocarbon coating on the swash plate facial surfaces and ends to reduce the frictional wear on the components. The coated swash plate may be made from lower cost alloy materials while maintaining durability and efficiency.

2. Description of the Related Art

Swash plate compressors have been used in automotive air conditioning systems for many years. In a swash plate type compressor, a swash plate rotates about a shaft. A number of pistons are arranged radially about the perimeter of the swash plate and slide within cylinder bores positioned parallel to the shaft. The facial and end surfaces of the swash plate contact pivoting shoes within the pistons. The rotation of the swash plate reciprocates the pistons. The reciprocating swash plate has a relatively high surface area that contacts the piston shoes. In addition to the large contact area, the type of contact also causes a large amount of friction. The rotating swash plate undergoes a shear-type contact with the piston shoes. The shearing force of the contact wears away many types of friction reducing coatings. The interfacial surfaces between the swash plate and pistons are subject to very high load conditions and are susceptible to premature wear before the remainder of the compressor. Protecting these surfaces from wear increases the life of the compressor and also increases the compressor efficiency.

It is known to coat the surface of an aluminum swash plate to reduce wear. Coatings as described in U.S. Pat. No. 5,056,417, issued Oct. 15, 1991, to Kato et al., include 50% by weight of tin and lesser portions of copper, nickel, zinc, lead and indium to form a metal matrix coating. Coatings of this type are electrolytically applied and usually require that the base material have a highly polished surface to provide maximum durability. These electroplated coatings also require that the swash plate be made from aluminum or aluminum alloy materials that contain hard second phase particles. Hard second phase particles mean second phase particles having an average particle diameter of 200 through 100 micrometers (μm) and a hardness greater than 300 on the Vicars hardness scale or, more preferably, having a hardness greater than 600 on the Vicars hardness scale, such as primary silicon. Especially preferred is an aluminum silicon alloy containing about 13 percent to 30 percent by weight of silicon. The high silicon aluminum and tin metal matrix coating gives the coated swash plate increased durability, but at the expense of frictional resistance.

To enhance the frictional properties of the electroplated swash plate, the 5,056,417 patent teaches the use of a solid lubricant such as fluororesin as part of the metal matrix coating. The fluororesin was added to the aqueous solution used in the chemical plating process. While the fluororesin coating provided a swash plate with a lower coefficient of friction, the surface coating layer exhibited a lower hardness than the tin matrix coating alone and was more susceptive to rapid abrasion.

Electroplated metal matrix coatings on aluminum components are acceptable under light loads, they have several disadvantages when used under high friction loads including the need for expensive, high silicon aluminum base materials; high surface finishing for the base material and a complex electroplating process. Adding the fluororesin to the metal matrix improved the coefficient of friction, but at the expense of surface hardness and durability.

It is desirable to provide a coating on a swash plate that is both friction reducing and highly durable. It is also desirable to provide a coating that permits the use of lower cost, low silicon aluminum base material for the swash plate. It is further desirable to provide a swash plate coating that does not require the need to electroplate the surface of the swash plate. These and other advantages of the present inventions will be more fully described below and in the accompanying drawings.

SUMMARY OF THE INVENTION

The present invention is directed to a swash plate type compressor having a cylinder block with cylinder bores disposed parallel to the axis of the cylinder block. A rotary shaft rotatably mounted within the cylinder block carries an aluminum swash plate. The swash plate is fixed to the rotary shaft and has two facial surfaces and an end surface. The facial surfaces have between 0.0005 inches (12.7 μm) to 0.002 inches (50.8 μm) of a heat curable, cross-linked coating comprising a polyfluoro elastomer bonded directly to the aluminum, a lubricious additive and a load bearing additive. A piston reciprocally fitted within the cylinder bore contains shoes which slideably intervene between the piston and the swash plate facial surfaces and reciprocate the pistons by rotation of the swash plate. The coating on the swash plate permits the use of low silicon alloy aluminum without the need of metal plating or high finish polishing.

The present invention is different from prior swash plate designs having fluororesin coatings by bonding and then cross-linking the fluorocarbon directly to the aluminum ahoy. The coating includes lubricious and load bearing additives to enable the polyfluoro elastomer-based coating to simultaneously provide the necessary durability and low coefficient of friction surface. The fluorocarbon coating is applied to the swash plate in a aqueous spray and then cured in an oven at an elevated temperature. The swash plate facial surfaces, together with the end surface, may be simultaneously coated. Additionally, the piston shoe may be coated with the fluorocarbon coating to further increase the low friction properties of the compressor.

DETAILED DESCRIPTION OF THE PREFERRED EMBODIMENTS

Figure 1:
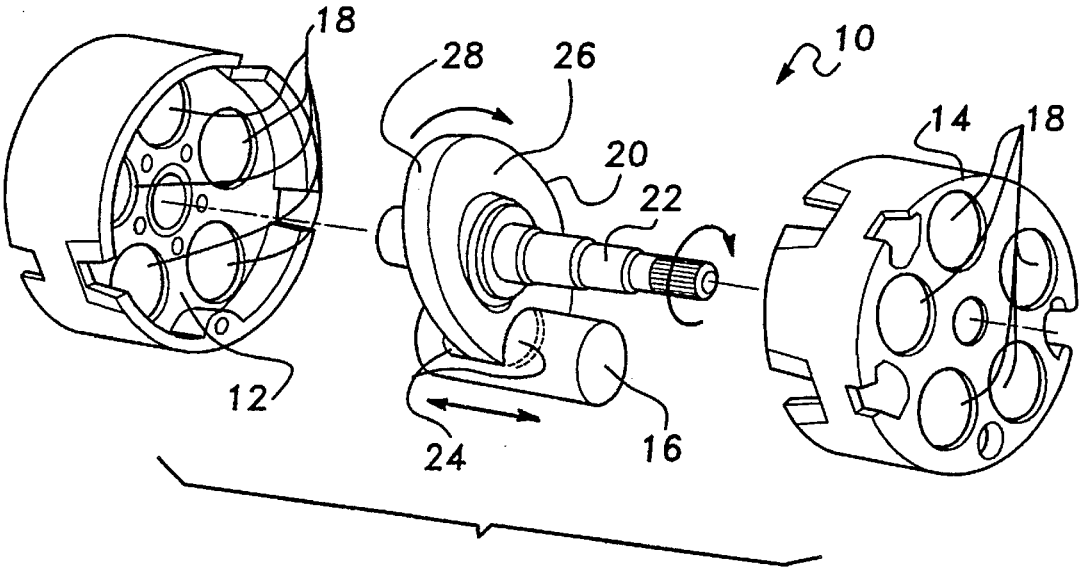
FIG. 1 is an exploded view of a swash plate compressor.

Illustrated in FIG. 1 is a perspective and exploded view of an automotive swash plate type compressor 10 for propelling refrigerant gas through a cooling circuit. The compressor 10 comprises a two-piece cylinder block 12, 14 which is provided with a plurality of reciprocating pistons 16. For clarity, FIG. 1 depicts only one of such reciprocating piston 16. In practice, each of the pistons 16 reciprocates within cylinder bore 18.

Each piston 16 is in communication with the swash plate 20 which is fixably mounted on an axially extending rotateable shaft 22. The reciprocating motion of each piston 16 within its associated cylinder bore successively siphons, compresses, and discharges refrigerant gas. A pair of pivoting shoes 24 are positioned between each piston 16 and swash plate 20. The shoe 24 transfers the rotational motion of the swash plate 20 to the linear motion of the piston 16. The swash plate 20 has two facial surfaces 26 (only one shown for clarity) which contact the shoes 24.

Rotation of the shaft 22 causes the swash plate 20 to rotate between the cylinder blocks 14, 16. The facial surfaces 26 contact the shoes 24 and are subjected to a shear-type frictional contact with the shoes 24. An end surface 28 may contact the piston 16 if the piston 16 is slightly skewed or bent. End surface 28 and the facial surfaces 26 are coated with a durable coating to prevent ware from the contact with the pistons 16 and the shoes 24. The coating should also have a low coefficient of friction to increase the efficiency of the compressor.

The swash plate 20 is usually made from an aluminum or aluminum alloy material to make it light-weight and strong. Aluminum and aluminum alloys containing hypereutectic silicon, that is more silicon than is required to form a eutectic crystalline structure, are often used. Hypereutectic silicon aluminum alloys provide a high degree of hardness on the Vickers scale. Unfortunately, hypereutectic aluminum is more expensive than non-hypereutectic aluminum materials and are more difficult to machine because of their hardness.

While the coating of the present invention may be used on hypereutectic aluminum, it is primarily intended for use on non-hypereutectic aluminum and aluminum alloys having less than 10% by weight of silicon. It was found that coated swash plates made from non-hypereutectic aluminum performed equal to hypereutectic alloys.

A coating is applied to the swash plate 20 by means of liquid spray. The shaft 22 is masked and the swash plate 20 is sprayed with an unlinked polyfluoro elastomer. The coating comprises a polyfluoro elastomer, a lubricious additive and a load bearing additive. The polyfluoro elastomer is dissolved in either a water base or hydrocarbon solution. The polyfluoro elastomer is selected from a class of materials which will form highly cross-linked long chain polymers. Especially preferred are polyfluoro elastomers of polytetraflouroethylene (PTFE). The PTFE cross linking occurs at an elevated temperature and produces a highly adherent coating with high load bearing and wear resistant properties. The polyfluoro elastomer, lubricious and load supporting additives are generally suspended or dissolved in a liquid to aid in applying the coating onto a surface. Typical solvents and carriers include N-methylpyrrolidone (NMP), naphtha, xylene, dimethylformamide (DMF) or ethyl acetate.

The lubricious additive is selected from a group of materials that provide reduced friction in applications that use little or no off (dry). Such lubricious materials include carbon black, molydisulfide, cesium fluoride, lithium fluoride and mixtures thereof. The load bearing additive is selected from a group of materials that provide high hardness and durability in dry conditions. Such load bearing materials include boron carbide, boron nitride, oxides of aluminum, oxides of magnesium, spinels of aluminum, spinels of magnesium, silicon carbide, silicon nitride, and mixtures thereof.

The lubricious and load bearing additives are generally both solid and constitute the solid portion of the application mixture. The PTFE is generally in a solution or slurry and constitutes the liquid portion of the application mixture. The ratio of liquid to solid portions is generally between 40% to 90% liquid portion to 60% to 10% solid portion. Most preferred is a ratio of 70% liquid portion to 30% solid portion. The ratio of lubricious additive to load bearing additive is generally between 5% to 30% lubricious additive to 5% to 30% load bearing additive. Most preferred is a ratio of 50% lubricious additive to 50% load bearing additive.

Application mixtures of PTFE, lubricious and load bearing additives are commercially available. Of the currently available commercial mixtures, the PTFE-based coating Fluorolon™325, manufactured by Impreglon Inc. is especially preferred.

Swash plate 20 is usually manufactured by a forging process and is made into a "near net shape". The forging operation requires several machining steps before swash plate 20 achieves its final production tolerance. If the swash plate is used uncoated or with a tin coating, it must be machined to a high polish of less than 0.000039 (1 μm). The coating process of the present invention does not require such a high surface finish on the swash plate. Rather, it is preferred that the swash plate 20 have a roughened surface on surfaces 26, 28 to give the coating a mechanism to mechanically attach to the swash plate 20. Preferred roughed surface textures have a roughness of between 0.000039–0.0012 inches (1–30 μm) and give maximum adhesion of the coating. The surface roughening may be formed on the swash plate surfaces by abrasive grit blasting with alumina oxide, electro-discharge machining, honing or rough machining. Chemical roughening (etching) can also be used.

Figure 2:
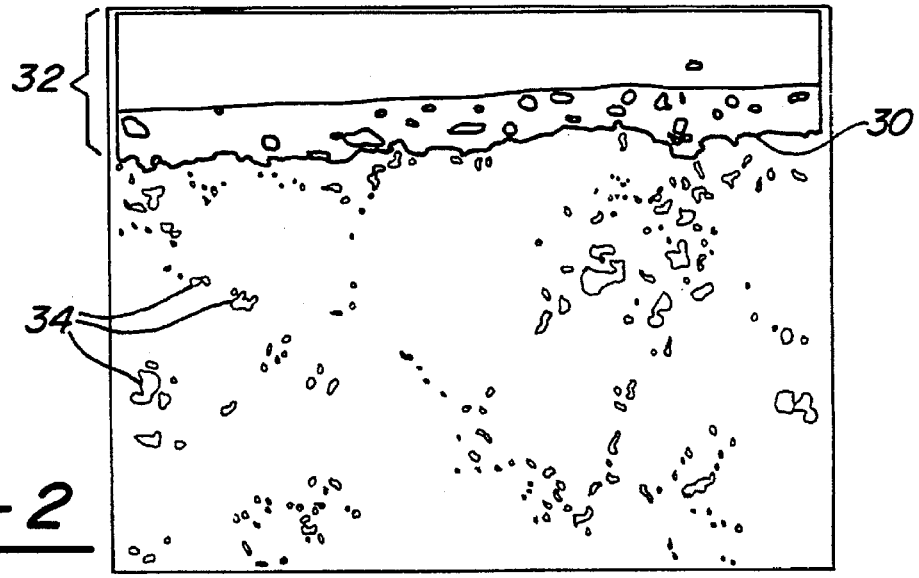
FIGS. 2 and 3 are cross-sectional photomicrographs of coated aluminum swash plates.
Figure 3:
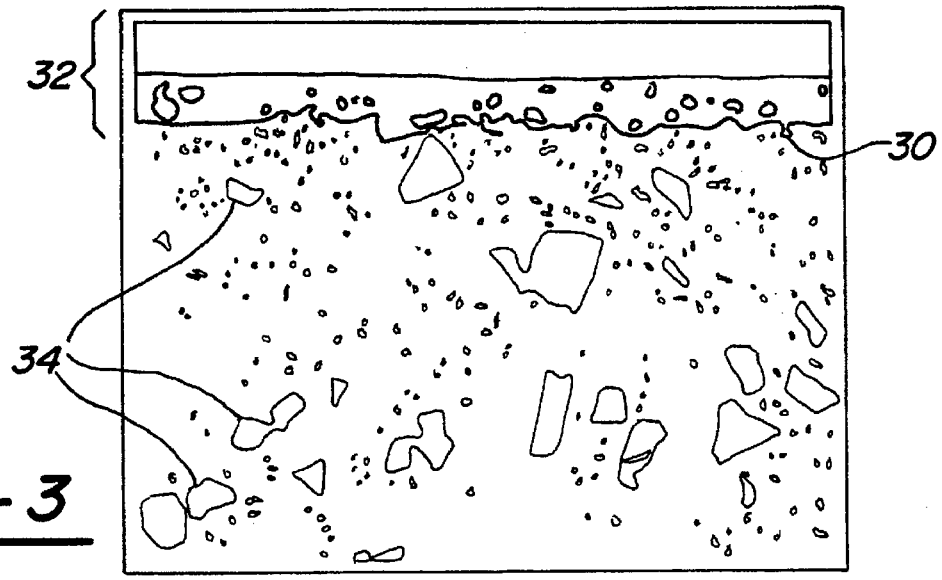

Photomicrographs showing a cross-sectional view of coated swash plates are reproduced in FIGS. 2 and 3. The roughed surfaces 30, 30' are machined to a surface roughness of approximately 0.000079 inches (2 μm). It is possible to achieve this surface roughness by grit blasting the surface of a polished article and therefore possibly eliminating a final machining step in the existing manufacturing process for swash plates. A solution of unlinked polyfluoro elastomer is applied to the roughened surfaces 30, 30'. Solvents in the polyfluoro elastomer coating evaporate and the coating adheres to the surfaces 30, 30'. The coated swash plate 20 is placed within a curing oven at a temperature of 450° F. for approximately ten minutes. The polyfluoro elastomer coating cross links and cures at the elevated temperature to form a coating 32. A coating thickness of approximately 0.0012 inch (30 μm) has been proven effective for use in swash plates having a shoe gap of between 0 to 0.000039 inches (0 to 1 μm). Thicker coatings are possible, but have not proven themselves to be as durable.

The coated swash plate exhibits very smooth facial surfaces 26 and end surface 28. Surface roughness for surfaces 26, 28 of approximately 0.000020 inch (0.5 μm) are possible using the coatings described. Because of these smooth surfaces, the use of the cross-linked polyfluoro elastomer coating may eliminate one or more machining step currently used in the manufacture of swash plates.

FIG. 2 shows a non-hypereutectic aluminum swash plate having approximately 7% by weight of silicon with the polyfluoro elastomer coating of the present invention. FIG. 3 shows a hypereutectic aluminum containing approximately 17% by weight of silicon. The silicon granules 34 are completely covered by the coating 32 and do not materially affect the durability or frictional properties of the swash plate.

Experimental Results

Figure 4:
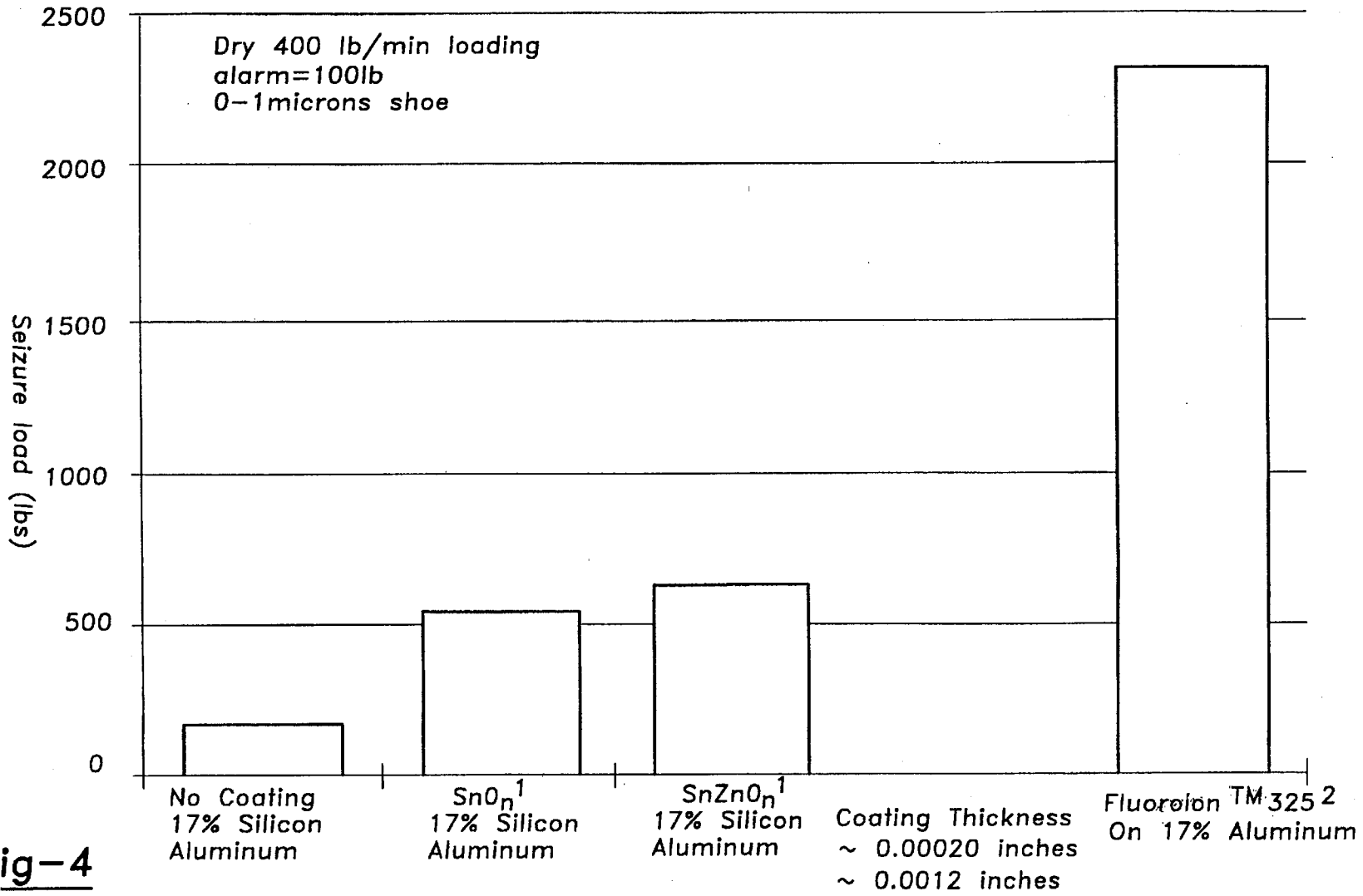
FIG. 4 is a comparison of seizure loads for coated and uncoated swash plates.

Illustrated in FIG. 4 is a comparison of the seizure loads of swash plates with: no coating; tin, tin/zinc; and Fluorolon™ 325 on 17% silicon Al. The Fluorolon™ coating includes approximately 70% of PTFE, 15% lubricious additive and 15% load bearing additive. The Fluorolon™325 coating is liquid and was sprayed on the swash plate facial and end surfaces. All measurements were taken dry with a 400 lb. per minute loading and a shoe gap between 0 and 0.000039 inches (0 to 1 μm). The Fluorolon™325 coated swash plate made with hypereutectic aluminum sustained seizure loads of over ten times greater than uncoated hypereutectic aluminum swash plates and approximately five times those of hypereutectic aluminum swash plates coated with tin or tin/zinc.

While not wishing to be bound by the following theory, it is believed that bonding the polyfluoro elastomer directly to the roughened aluminum increases the performance of the swash plate over that of adding the fluorocarbon to a polished surface because the bond between the polyfluoro elastomer is both a mechanical and chemical bond. The fluorocarbon alone is insufficient to provide the durability needed for use on a swash plate. Combining the fluorocarbon with metals such and tin or zinc enhances durability but requires polishing the swash plate and thus reduces the mechanical adhesion of the fluorocarbon. By eliminating the need for the metal coatings, the surface of the swash plate may be toughened to provide the mechanical adhesion needed by the polyfluoro elastomer coating. The polyfluoro elastomer coating, together with the lubricous and load bearing additives is sufficiently durable that metal coatings or hypereutectic base materials may not be needed. The load bearing additives do not require the high surface finish metals such as tin and zinc require.

Swash plates coated with the polyfluoro elastomer coating do not exhibit the poor hardness characteristics of prior fluorocarbon resin compositions because of the load bearing additives. Adhesion between the polyfluoro elastomer and aluminum surface is very high because cross-linked polyfluoro elastomer is mechanically bonded to the aluminum surface.

Figure 5:
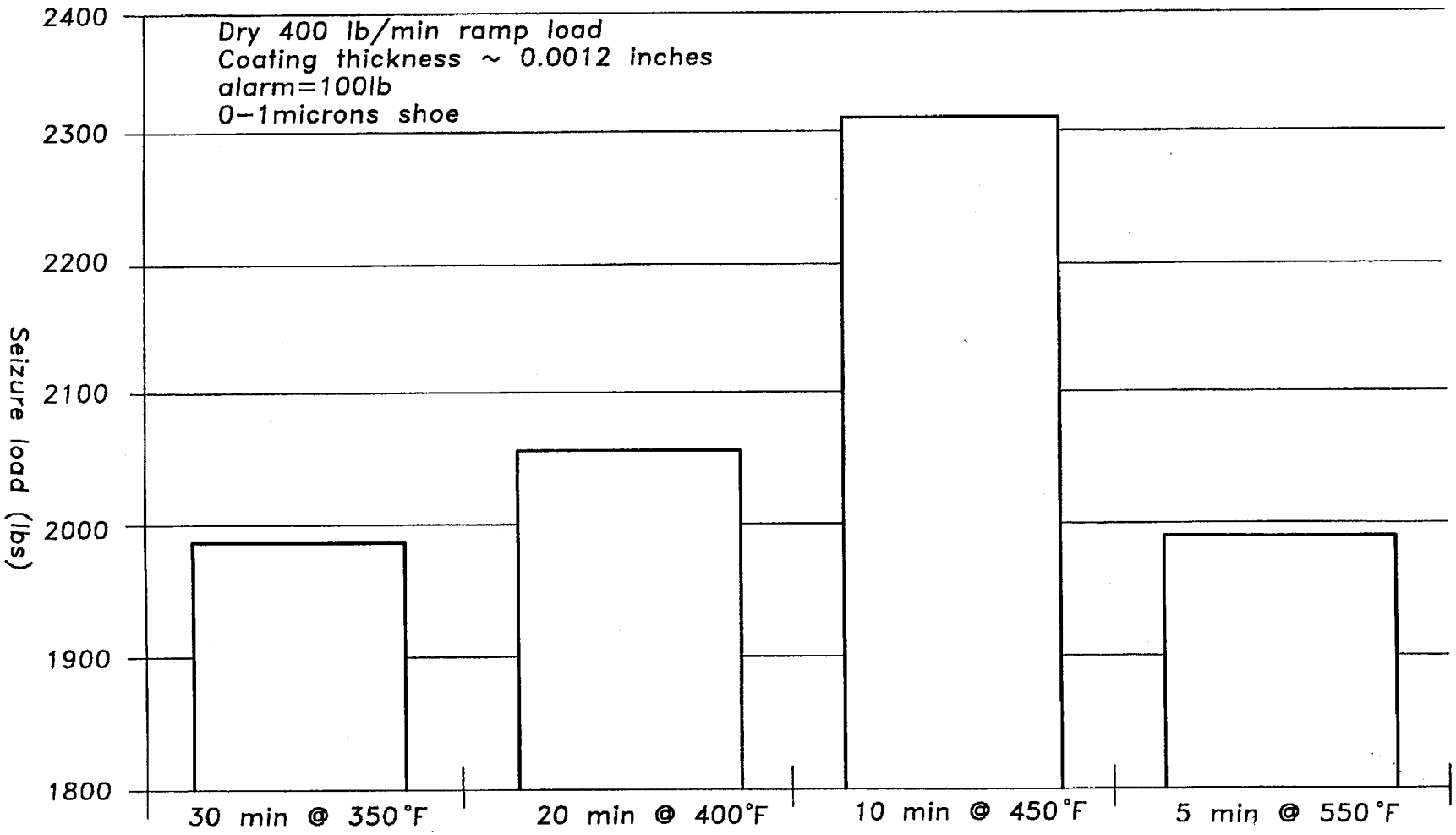
FIG. 5 is a comparison of seizure loads for swash plates having a PTFE fluorocarbon coating cured to different temperatures and times.

Illustrated in FIG. 5 are the effects of curing times and temperatures on the durability of the coating. Aluminum swash plates containing 17% silicon were coated with 0.0012 inches (80 μm) of Flurolon™325 polyfluoro elastomer and cured at the temperatures and times shown. Both under curing and over curing the polyfluoro elastomer reduces the durability of the coating as measured by the seizure loads. It is believed that the curing temperature and curing time effect the amount of cross-linking and therefore the strength of the mechanical attachment of the polyfluoro elastomer to the base material. All measurements were taken dry at a loading of 400 lb. per minute. Preferred curing times and temperatures for the Flurolon™325 coating were about 10 minutes at 450° F.

Figure 6:
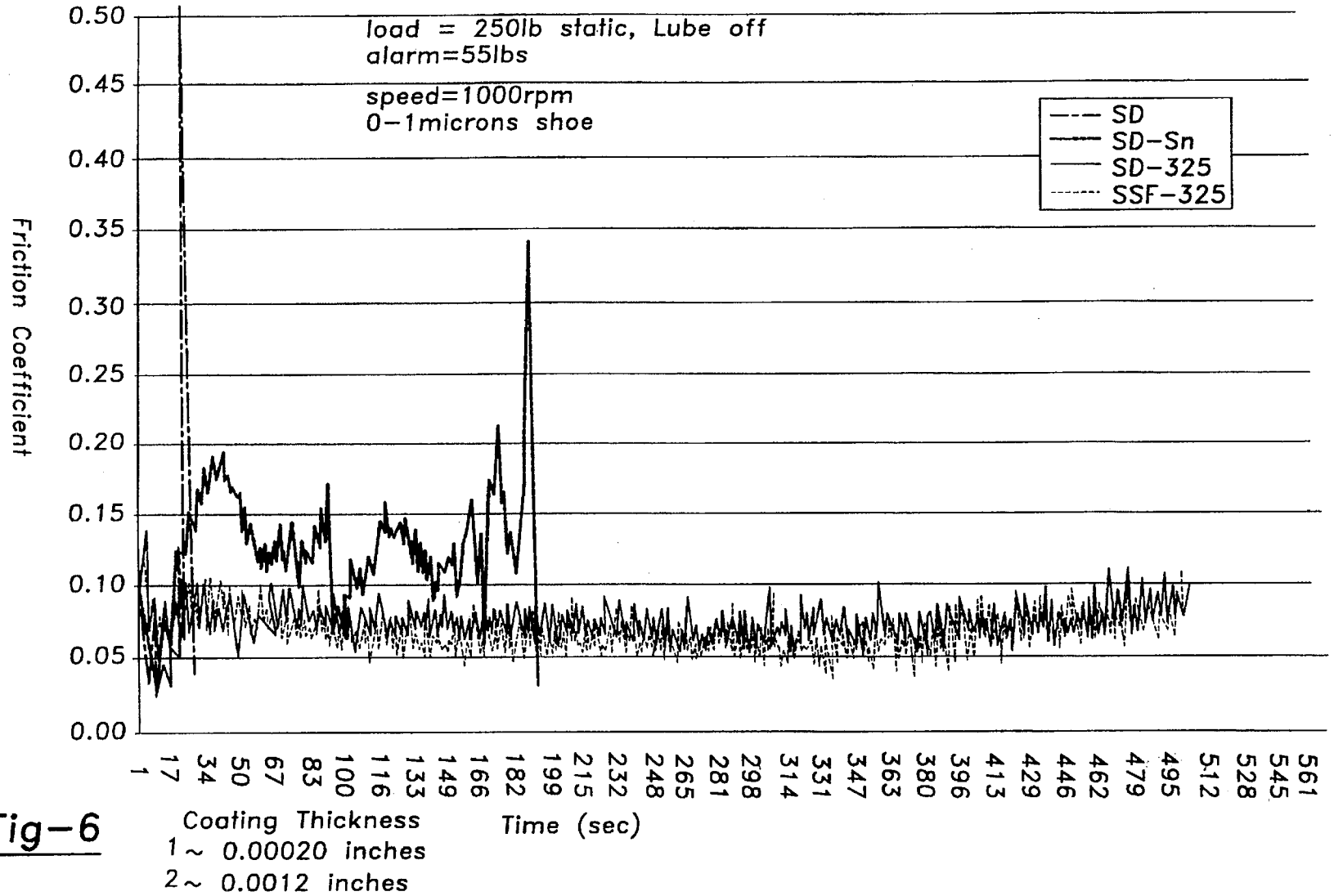
FIG. 6 is a comparison of the friction coefficient for coated and uncoated swash plates.

Illustrated in FIG. 6 is a comparison of the friction coefficient of coated and uncoated swash plates. The data is also summarized in the following table:

TABLE 1

| Failure Time | Coating and Substrate |
|---|---|
| 26 sec. | Uncoated 17% silicon aluminum (SD) |
| 19.5 sec. | Tin coated 17% silicon aluminum (SD-Sn) |

TABLE 1-continued

| Failure Time | Coating and Substrate |
|---|---|
| No failure | Cross-linked Fluorolon ™ 325 on 17% silicon aluminum (SD-325) |
| No failure | Cross-linked Fluorolon ™ 325 on 7% silicon aluminum (SSF-325) |

An uncoated hypereutectic swash plate exhibits a high friction coefficient at approximately 26 seconds into testing. A hypereutectic swash plate with a tin coating exhibits a high friction coefficient at approximately 195 seconds into testing. Hypereutectic and non-hypereutectic swash plates coated with the PTFE polyfluoro elastomer Fluorolon™325 maintain a low friction coefficient throughout sustained testing. Non-hypereutectic aluminum swash plates perform equal to hypereutectic aluminum swash plates with the PTFE polyfluoro elastomer coating and better than hypereutectic aluminum swash plates with a tin coating.

The coating 32 in FIGS. 2 and 3 is approximately 100% PTFE polyfluoro elastomer and has a thickness of approximately 0.0012 inches (30 μm) when the underlying surface 30, 30' has a roughness of 0.000079 inches (2 μm). Thinner coatings 32 may be applied when the roughness of surfaces of 30, 30' is finer, however, this may negatively affect the adhesion of coating 32 to surfaces 30, 30'. Coatings thicker than 0.0012 inches (30 μm) are not preferred because they tend to degrade under high loads and are not as durable.

It is possible to apply a thicker coating to swash plate 20 and then machine off the excess coating using conventional machining tools. This adds an additional step to the manufacturing process and is generally not needed because the coating thickness may be controlled through the application process, and the resulting coating finish is smooth enough for normal automotive swash plates.

It will be obvious to those of skill in the art that various modifications variations may be made to the foregoing invention without departing from the spirit and scope of the following claims.

What is claimed:

1. A swash plate type compressor comprising:

a cylinder block having a cylinder bore disposed parallel to the axis of said cylinder block;

a rotary shaft ratably mounted within said cylinder block;

an aluminum containing swash plate fixed to said rotary shaft for rotation within said cylinder block, said swash plate having two facial surfaces and an end surface, said facial surfaces having a coating of between 0.0005 inches to 0.002 inches; said coating consisting of between 40% and 90% of a heat curable, cross-linked polyfluoro elastomer bonded directly to said aluminum, and between 5% and 30% of a lubricous additive, and between 5% and 30% of a load bearing additive;

a piston reciprocally fitted in said cylinder bore; and shoes which slidably intervene between said piston and said swash plate facial surfaces and reciprocate said piston by rotations of said swash plate.

2. The swash plate type compressor of claim 1, wherein said swash plate comprises an aluminum-silicon type alloy having 13% or less by weight of silicon.

3. The swash plate type compressor of claim 2, wherein said swash plate comprises an aluminum-silicon type alloy having about 7% by weight of silicon.

4. The swash plate type compressor of claim 1, wherein said polyfluoro elastomer consists essentially of PTFE.

5. The swash plate type compressor of claim 1, wherein said lubricious additive is selected from the group comprising: carbon black, molydisulfide, cesium fluoride, lithium fluoride or mixtures thereof.

6. The swash plate type compressor of claim 1, wherein said load bearing additive is selected from the group comprising boron carbide, boron nitride, oxides of aluminum, oxides of magnesium, spinels of aluminum, spinels of magnesium, silicon carbide, silicon nitride, or mixtures thereof.

7. A method of manufacturing a swash plate for a swash plate type compressor comprising the steps of:

forging a swash plate from a low silicon aluminum alloy which includes less than 13% by weight of silicon, said swash plate having two facial surfaces and an end surface;

machining said swash plate to its desired dimensions;

abrading the facial surfaces to a roughness between 0.000039 and 0.0012 inches (1 to 30 μm);

spraying a coating comprising a polyfluoro elastomer, a lubricious additive and a load bearing additive on said facial surfaces; and curing said coated swash plate at an elevated temperature to cure said coating and to bond said coating directly to said aluminum alloy.

8. The method of claim 7, wherein said polyfluoro elastomer consists essentially of PTFE; and wherein said lubricious additive is selected from the group comprising carbon black, molydisulfide, cesium fluoride, lithium fluoride or mixtures thereof; and wherein said load bearing additive is selected from the group comprising boron carbide, boron nitride, oxides of aluminum, oxides of magnesium, spinels of aluminum, spinels of magnesium, silicon carbide, silicon nitride, or mixtures thereof.

* * * * *